US006543679B2

(12) United States Patent
Cai et al.

(10) Patent No.: US 6,543,679 B2
(45) Date of Patent: Apr. 8, 2003

(54) STACKABLE FOOD TRAY WITH CONDIMENT COMPARTMENT

(75) Inventors: Liming Cai, West Chester, PA (US); Larry Eisman, Elkins Park, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/892,653

(22) Filed: Jun. 28, 2001

(65) Prior Publication Data

US 2002/0011514 A1 Jan. 31, 2002

Related U.S. Application Data

(60) Provisional application No. 60/214,438, filed on Jun. 28, 2000.

(51) Int. Cl.[7] ..... B65D 5/4805

(52) U.S. Cl. ..... 229/120.06; 229/120.18; 229/120.35; 229/160.2; 229/904; 229/906

(58) Field of Search ..... 229/120.06, 120.12, 229/120.18, 120.29, 120.31, 120.35, 120.38, 160.2, 902, 904, 906

(56) References Cited

U.S. PATENT DOCUMENTS 2,794,585 A * 6/1957 Wagner ..... 229/904
4,081,125 A * 3/1978 Meyers ..... 229/120.18
4,089,458 A * 5/1978 Meyers et al. ..... 229/120.06
4,126,261 A 11/1978 Cook
4,955,528 A 9/1990 Schluckebier
5,335,845 A * 8/1994 Liu ..... 229/120.18
5,520,324 A 5/1996 Cai
5,655,707 A * 8/1997 Jensen ..... 229/160.2
5,720,429 A 2/1998 Cordle
5,735,454 A * 4/1998 Jensen ..... 229/160.2
5,842,631 A 12/1998 Berger
6,102,208 A * 8/2000 Huang ..... 229/120.18
6,119,930 A * 9/2000 Lunstra et al. ..... 229/906

* cited by examiner

*Primary Examiner*—Gary E. Elkins
(74) *Attorney, Agent, or Firm*—Dennison, Schultz & Dougherty

(57) ABSTRACT

A food tray for holding food and a condiment is formed from a unitary paperboard blank. The food tray has a food compartment and a condiment compartment, and the condiment compartment is deployable from a stowed position overlaying one or more sidewalls of the food compartment to a deployed position for holding condiments. Multiple trays can be stacked in a nested fashion when the condiment compartment is stowed.

27 Claims, 8 Drawing Sheets

STACKABLE FOOD TRAY WITH CONDIMENT COMPARTMENT

CROSS REFERENCE TO RELATED APPLICATIONS

This application claims the benefit of the U.S. Provisional patent application No. 60/214,438 filed on Jun. 28, 2000, the contents of which are incorporated herein by reference.

TECHNICAL FIELD

The present invention relates generally to food trays, and more particularly to food trays having selectively deployable condiment compartments.

BACKGROUND OF THE INVENTION

Finger foods, such as chicken nuggets, popcorn shrimp, french fries, and onion rings, are often served in paperboard trays. These trays have flat bottom walls and side walls that extend upwardly therefrom at an angle to define a top opening larger than the bottom wall. In the interest of space efficiency, these trays are preferably stackable or nestable so that one tray fits inside another tray. This allows large stacks of trays to be shipped and stored in a relatively small space until needed.

Many of the above foods are frequently eaten with condiments such as ketchup, cocktail sauce, and barbeque sauce. Since these foods are often eaten with one's fingers, a person typically holds a food item in his fingers and dips it into a condiment. When eating in a sit-down restaurant, the condiment may be dispensed directly into the paperboard tray next to or on top of the food product, or a tub of the condiment can be placed on a table next to the consumer. When consuming such products in an automobile or while walking, however, the option of using a tub of condiment becomes more difficult. Furthermore, because semi-liquid condiments tend to run, it is difficult to keep the condiments and food products separate, and a user is often left with some products that are substantially covered with condiment and with condiment spread over the entire bottom wall of the container. The more the container is moved during use, the more the condiment is likely to move.

Fast food containers having a condiment compartment, such as the one shown in U.S. Pat. No. 4,126,261 for "Disposable Food Tray With Condiment Container" issued to Cook on Nov. 21, 1978, are known in the prior art. However, in the first embodiment of the invention shown in the '261 patent, a condiment holder must be formed from a separate piece of material and then affixed to the main container, resulting in increased assembly costs. In the second embodiment of the invention shown in the '261 patent, the condiment holder is made from the same blank as the tray, but produces a finished product that is not stackable.

It would therefore be desirable to produce a stackable tray having an integral condiment compartment formed from a unitary blank of material.

SUMMARY OF THE INVENTION

These problems and others are addressed by the present invention which comprises a novel tray structure that is stackable and nestable and that includes one or more fold-out walls that form at least one compartment for holding a condiment substantially separate from a food product. The invention also comprises a unitary blank for making such a tray which blank is cut form a sheet of stock material in a manner that makes efficient use of the material, minimizes waste, and provides for an accurate assembly of the food tray.

According to the invention, a tray includes a movable wall or panel foldable between a first position flush with one or more sidewalls of the tray and a second position spaced apart from the one or more sidewalls to define a compartment between the sidewalls and the movable wall. This arrangement allows trays to be stacked and nested when the movable wall is in a stowed position flush with a side wall. When the condiment compartment is in its stowed position, the trays can also be used in the same manner as ordinary trays. To use the condiment compartment, it is merely necessary to flip the wall inwardly from the sidewall. The flexibility of the wall allows the wall to be shifted with very little effort.

In a first embodiment of the invention, the condiment compartment is formed across a corner of the tray and connected to two adjacent tray sidewalls. When flipped open into a deployed position, a pyramidal condiment compartment is formed in one corner of the tray.

In a second embodiment, a movable wall is formed between two parallel sidewalls of the tray. When flipped open, the wall defines a compartment spanning the length or width of the rectangular tray between the movable wall and one of the tray sidewalls.

In a third embodiment, the tray includes two condiment compartments along opposite sides of the rectangular compartment each formed by a moveable wall.

In a fourth embodiment, the tray is formed much like the tray of the second embodiment but the top edge of one tray wall and the top edge of the movable wall forming the condiment compartment have curved portions to provide for an increased gripping surface.

It is therefore a primary object of the present invention to provide a stackable container having an interior wall that can be deployed to form an interior compartment.

It is a further object of the present invention to provide a stackable container having a secondary compartment formed from a unitary blank of material.

It is another object of the present invention to provide a stackable food tray having a selectively deployable condiment compartment.

It is still a further object of the present invention to provide a food tray having a deployable corner compartment.

It is still another object of the present invention to provide a stackable food tray having a condiment compartment that is shiftable between a use and a storage position.

It is yet another object of the present invention to provide a unitary blank for forming a food tray having the above characteristics.

These features and advantages will be better appreciated and understood by those skilled in the art after reading the following detailed description of several preferred embodiments of the invention in connection with the drawings and appended claims.

BRIEF DESCRIPTION OF DRAWINGS

The present invention will now be described, by way of example, with reference to the accompanying drawings, of which.

DETAILED DESCRIPTION OF THE INVENTION

Figure 1:
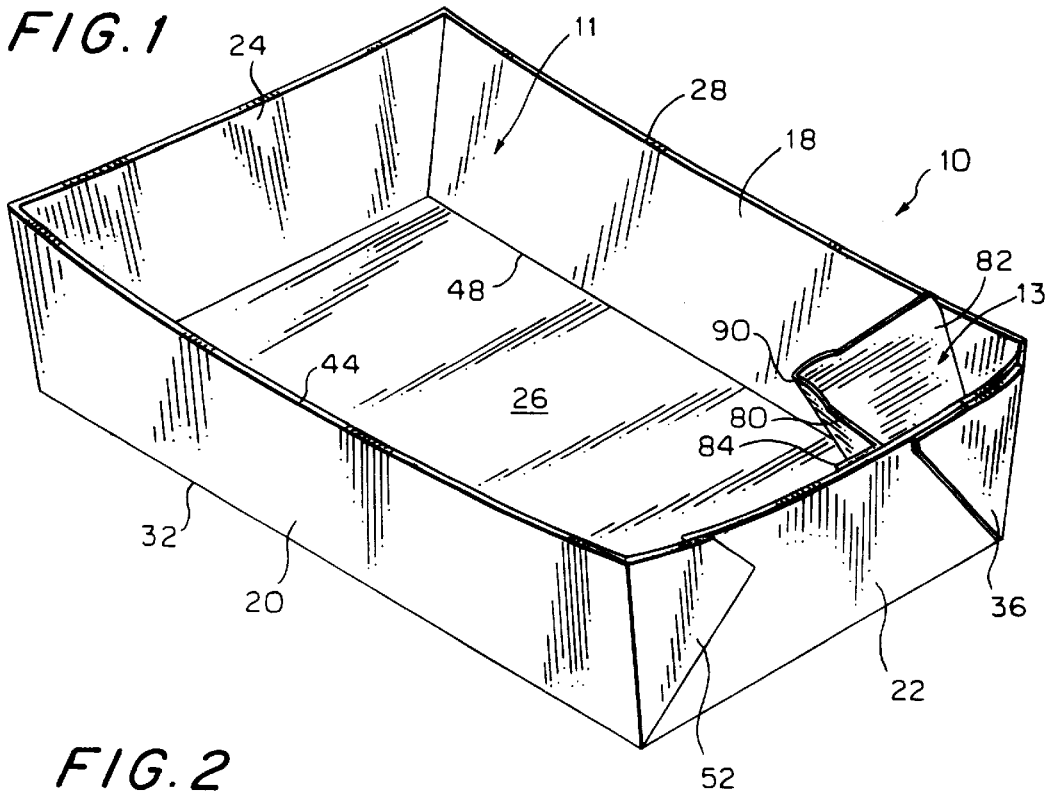
FIG. 1 is a perspective view of a food tray having a condiment compartment according to a first embodiment of the invention.
Figure 2:
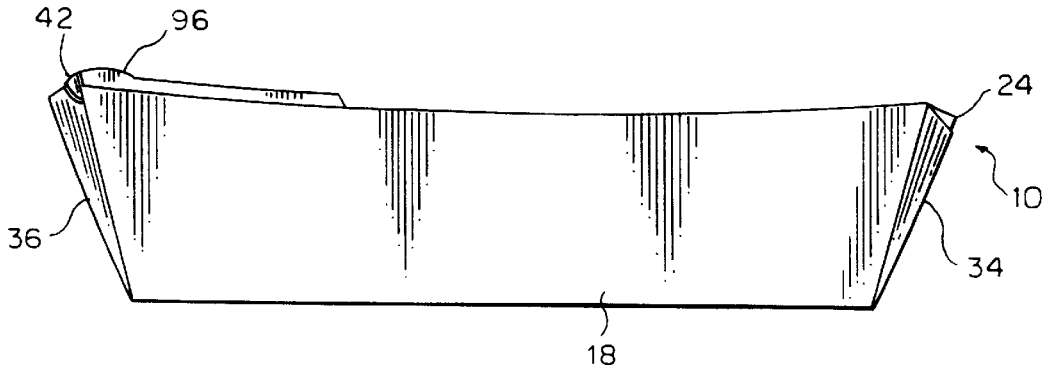
FIG. 2 is a right side elevation view of the tray of FIG. 1.
Figure 3:
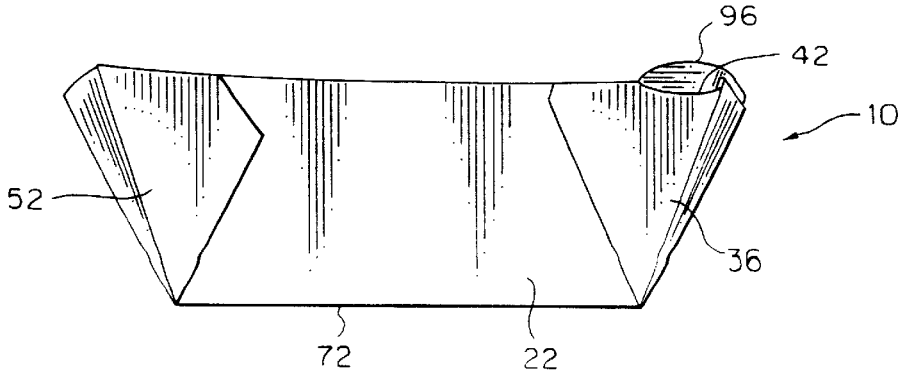
FIG. 3 is a front elevation view of the tray of FIG. 1.
Figure 4:
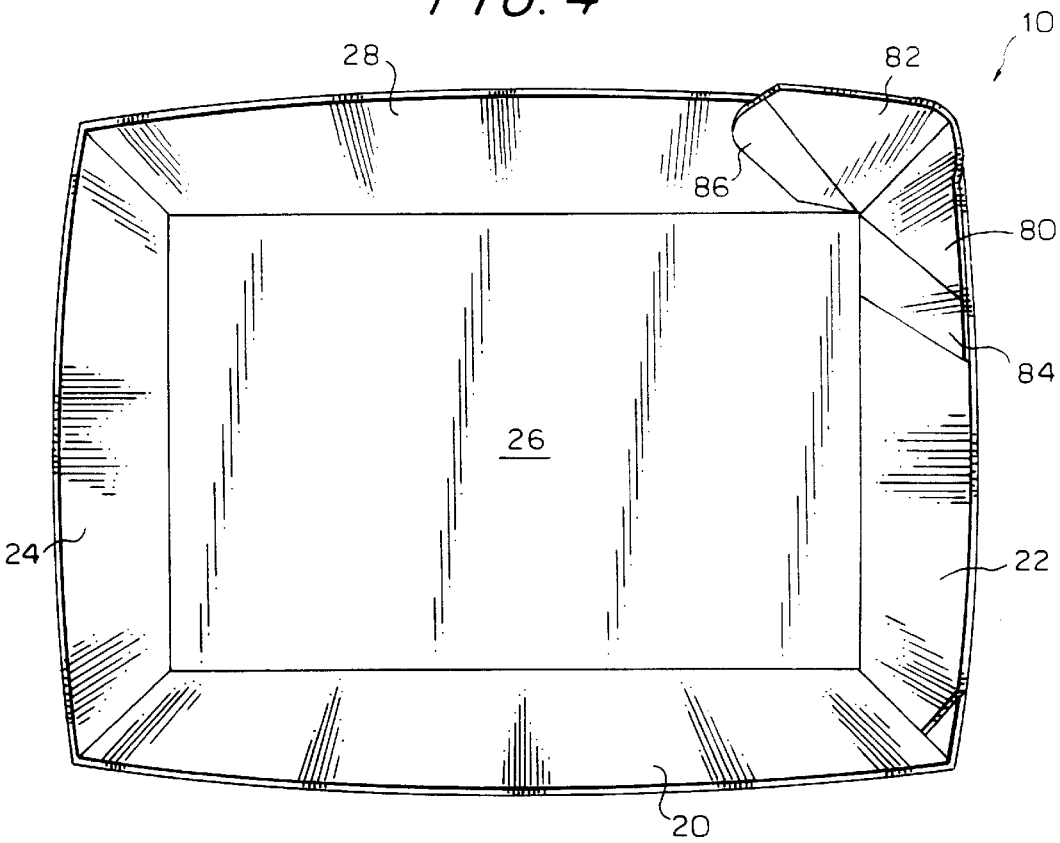
FIG. 4 is a top plan view of the tray of FIG. 1 with the condiment compartment wall in a stowed position.

Referring now to the drawings, wherein the showings are for the purpose of illustrating several embodiments of the invention only and not for the purpose of limiting same, FIG. 1 illustrates a food tray 10 that is assembled by folding and gluing a unitary blank 12 of paperboard stock. To facilitate the description of the present invention, the tray will be generally described in a position in which it is normally used by a consumer, that is, with the opening for food at the top and with the bottom wall resting on a flat support surface (not shown).

Referring to FIGS. 1–6, tray 10 includes a food compartment 11 and a condiment compartment 13. Food compartment 11 has a pair of opposed first and second sidewalls 18, 20, a front wall 22, a rear wall 24, and a bottom panel 26. First sidewall 18 has an upper edge 28, and is joined with bottom panel 26 along a first fold line 32.

First and second triangular glue flaps 34, 36 are coextensive and integral with the edges of first sidewall 18 and are connected thereto at a second fold line 38 and a third fold line 40 respectively. Second and third fold lines 38, 40 are outwardly divergent, making first sidewall 18 trapezoidal. Second triangular glue flap 36 has a concave upper edge portion 42 which, as will be explained hereinafter, provides access to the condiment compartment movable wall so that wall can be moved.

Second sidewall 20 has an upper edge 44, and is joined with the bottom panel edge along a fourth fold line 48 generally running parallel to first fold line 32. Third and fourth triangular glue flaps 50, 52 are integral with rear and front edges of second sidewall 20 and are joined to the second sidewall along a fifth fold line 54 and a sixth fold line 56 respectively, which the fold lines are mutually divergent.

Rear wall 24 is trapezoidal, includes an upper edge 60, and is joined at its lower edge with the rear edge of the bottom panel along a seventh fold line 62 generally perpendicular to first and fourth fold lines 32, 48. Rear wall 24 further includes slanted side edges 64, 66.

Front wall 22 has an upper edge 68, and a bottom edge that meets bottom panel 26 along an eighth fold line 72 generally parallel to seventh fold line 62. Front wall 22 also includes two opposed slanted side edges 74 and 76 and a concave upper edge portion 78 which overlays the concave edge portion 42 of second triangular glue flap 36 when condiment compartment 13 is in a stowed position.

Condiment compartment 13, which is more specifically defined as the area between first and second triangular walls 80 and 82, a portion of first sidewall 18, and a portion of front wall 22, and which is integral with the food compartment, includes a first triangular wall 80, a second triangular wall 82 joined and coextensive with first triangular wall 80 along a ninth fold line 90, a first condiment compartment glue flap 84 joined and integral with first triangular wall 80 along a tenth fold line 88, and a second condiment compartment glue flap 86 integral and coextensive with second triangular wall 82 along an eleventh fold line 92.

First glue flap 84 is joined and integral with upper edge 68 of front wall 22 along a twelfth fold line 94 from which second portion 16 as a whole is attached to first portion 14 of unitary blank 12.

First triangular wall 80 of condiment compartment 13 has a convex edge portion 96 along its upper edge where, in the folded configuration of the condiment compartment, convex edge portion 96 extends peripherally beyond concave edge portion 78 of the front wall 22 and concave edge portion 42 of second triangular glue flap 36. Convex edge portion 96 provides a gripping location at which the condiment compartment walls can be gripped and pulled out into a deployed or use position.

Figure 5:
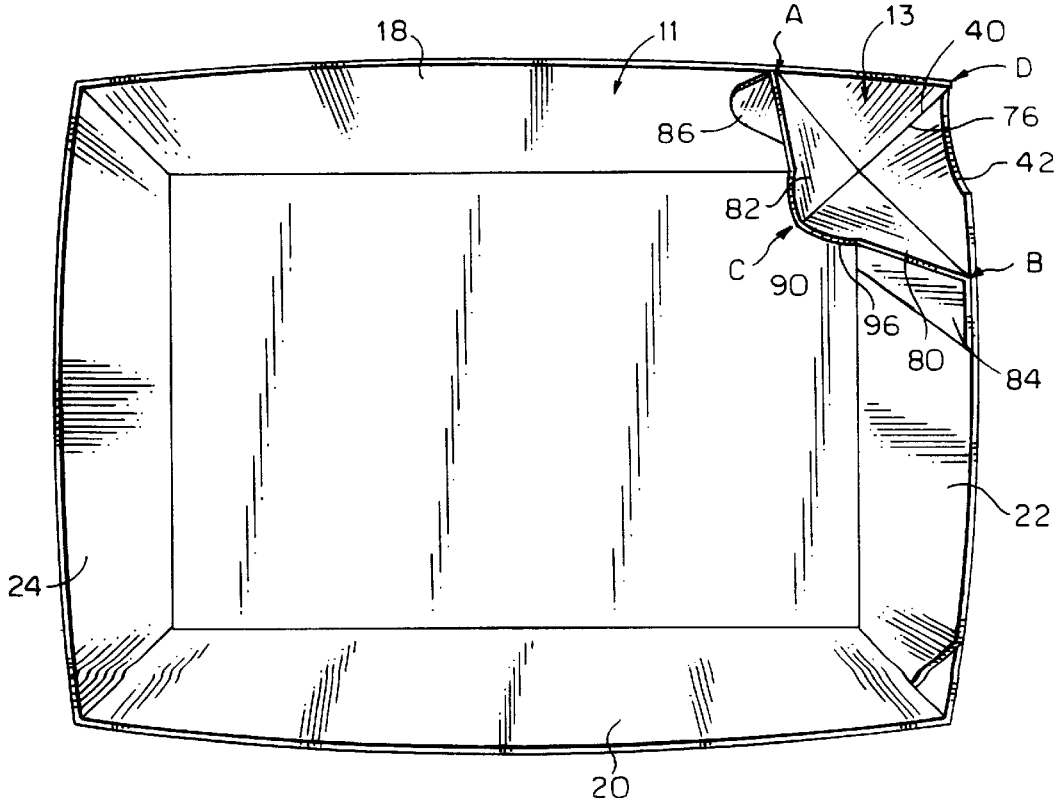
FIG. 5 is a top plan view of the tray of FIG. 1 with the condiment compartment wall in a deployed position.
Figure 6:
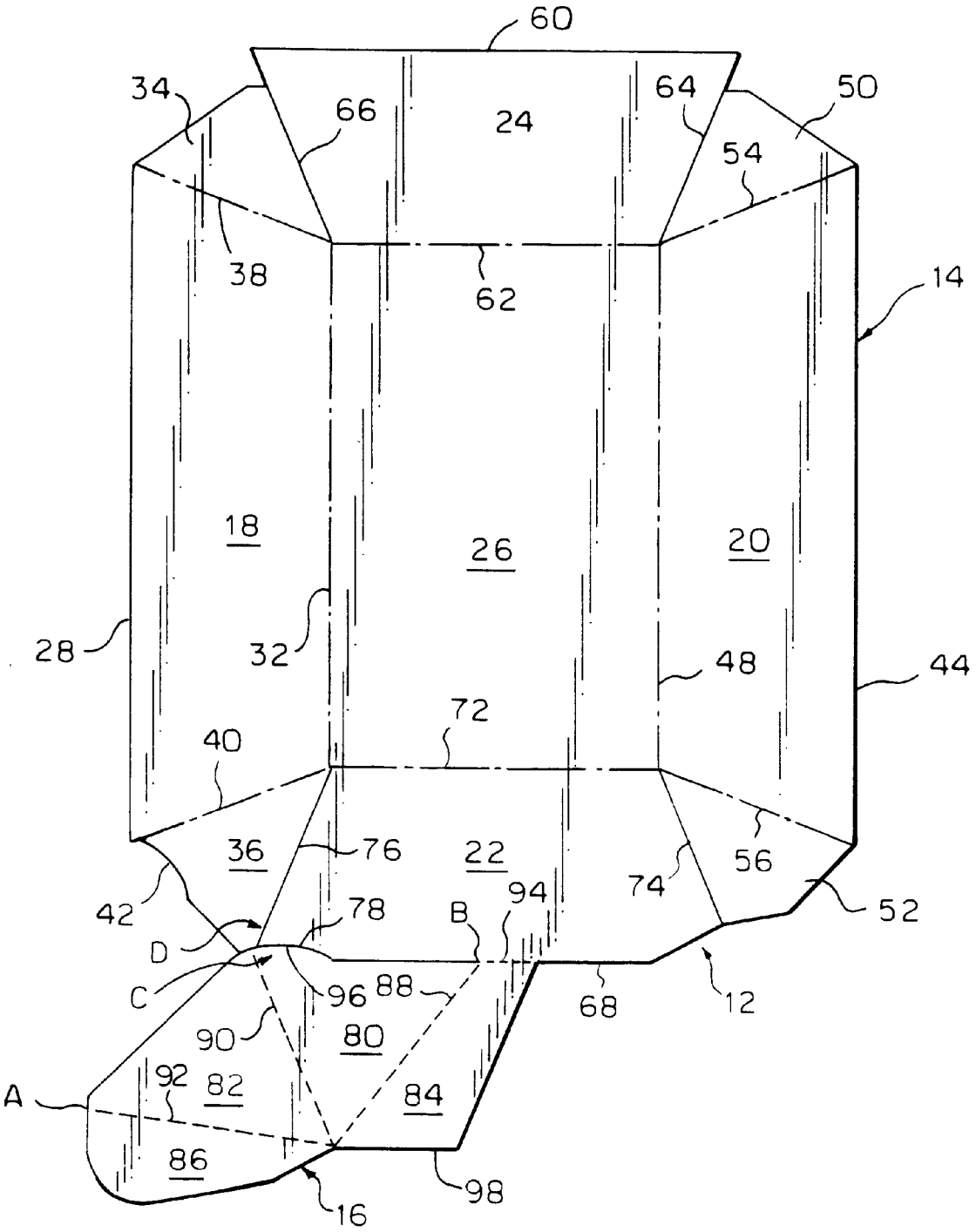
FIG. 6 is a plan view of a blank for forming the tray of FIG. 1.
Figure 7:
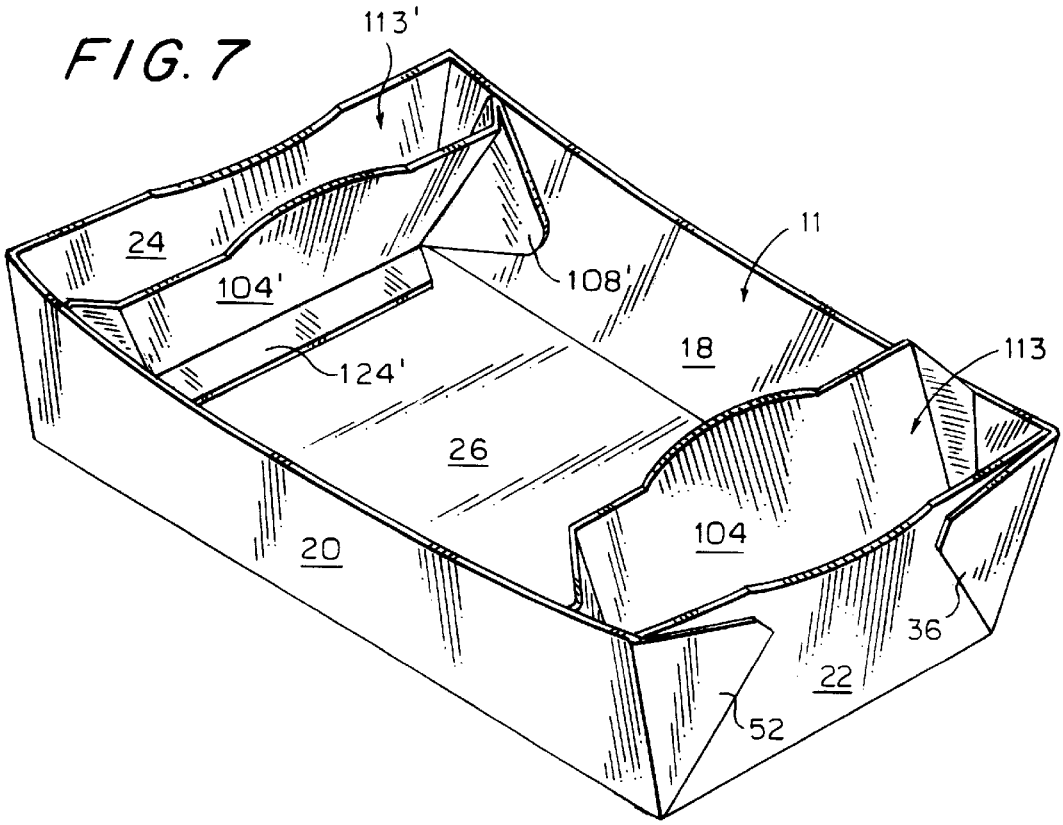
FIG. 7 is a perspective view of a food tray according to a second embodiment of the present invention having two condiment compartments both shown in deployed positions.
Figure 8:
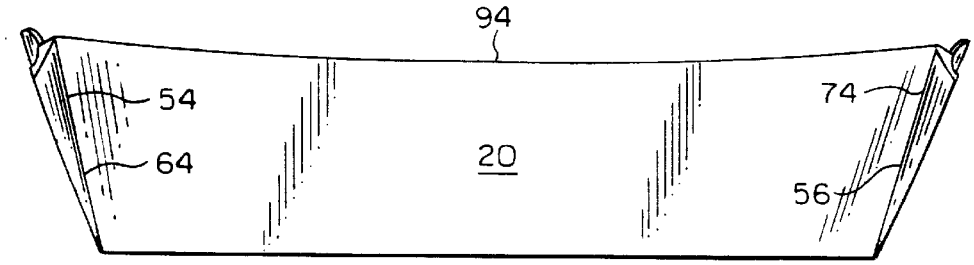
FIG. 8 is a left side elevation view of the tray of FIG. 7.
Figure 9:
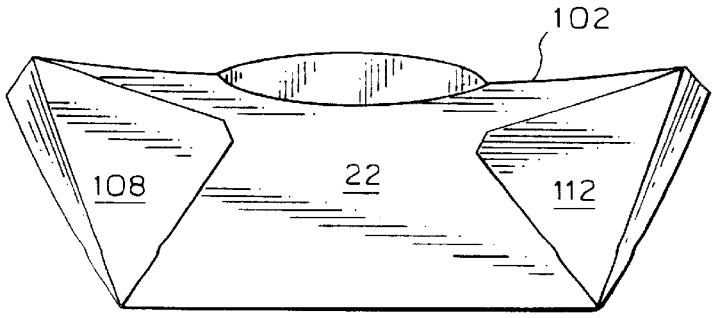
FIG. 9 is a front elevation view of the tray of FIG. 7.
Figure 10:
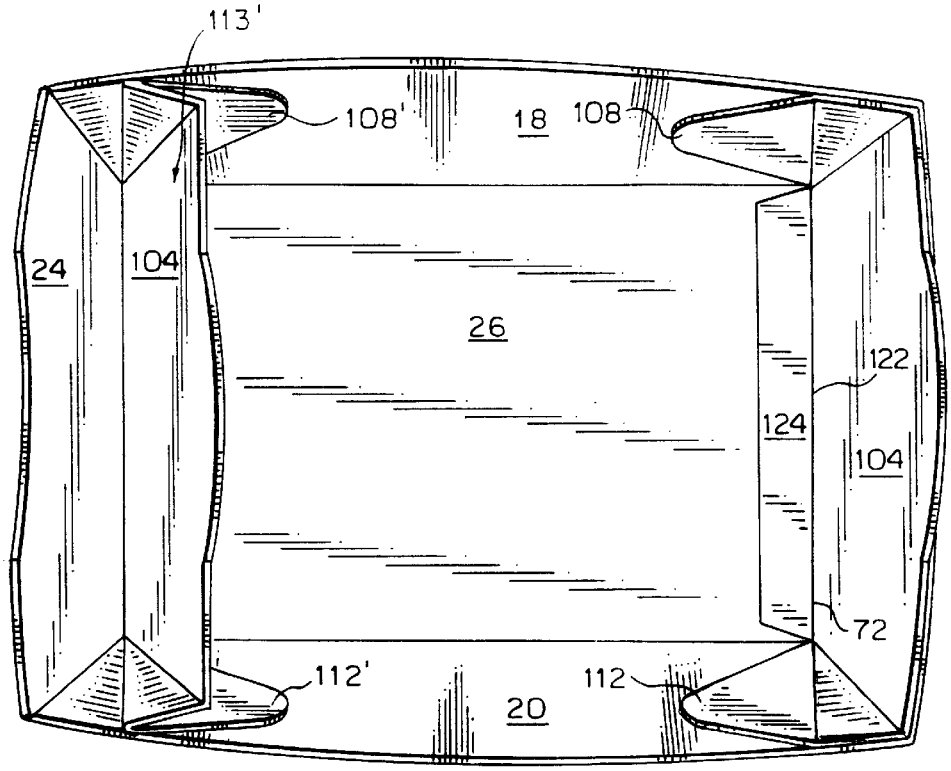
FIG. 10 is a top plan view of the tray of FIG. 7 showing only one of the two compartments in a deployed position.

In the preferred embodiment, first and second triangular walls 80, 82 are generally isosceles. That is, tenth fold line 88, ninth fold line 90, and eleventh fold line 92 all have about the same length. Moreover, as best seen in FIGS. 5 and 6, the distance between a first point A and a second point B in the assembled, and deployed, condiment compartment 13 is less than the distance between point C and point D of the second portion of panel 16. These relative distances, as will be explained herein, provide for a snap-out deployment of condiment compartment 13 which allows condiment compartment 13 to stay in a deployed configuration without any condiment inside. As best seen in FIG. 5, condiment compartment 13 has an inverted pyramid shape in its deployed position.

It should also be appreciated that the bottom portion of the inverted pyramid shaped condiment compartment is held closely against the lower edge of the front wall of the tray. That is, edge 98 of first glue flap 84 overlays eighth fold line 72 of the tray.

The assembly of tray 10 will now be explained with reference to the blank shown in FIG. 6. First sidewall 18 is folded up along first fold line 32 toward bottom panel 26. Second sidewall 20 is folded up along fourth fold line 48 toward bottom panel 26. Rear wall 24 is then folded up along seventh fold line 62. Next, first triangular glue flap 34 is folded along second fold line 38 inwardly where side edge 66 coincides with second fold line 38 and then glue flap 34 is adhesively bonded onto the back surface of rear wall 24. Similarly, third triangular glue flap 50 is folded along fifth fold line 54 inwardly and behind rear wall 24 until side edge 64 coincides on top of fifth fold line 54 and then third triangular glue flap 50 is adhesively bonded to the back surface of rear wall 24.

Second and fourth triangular glue flaps 36 and 52 are folded along third and sixth fold lines 40 and 56, respectively, and are adhesively bonded to the back surface of front wall 22, where side edge 76 coincides on top of third fold line 40, and side edge 74 coincides on top of sixth fold line 56.

At this point, food compartment 11 of tray 10 is assembled. Now, the assembly of condiment compartment 13, which is integral with the food compartment will be described.

Second triangular wall 82 is folded under first triangular wall 80 along ninth fold line 90 and the two triangular walls are symmetrically placed on top of one another. Eleventh fold line 92 coincides along tenth fold line 88 as second condiment glue flap 86 partially overlays on first condiment glue flap 84.

Next, second portion 16 as a whole is folded up and into the food compartment along twelfth fold line 94 until first triangular wall 80 and first condiment glue flap 84 are flush with front wall 22 of tray 10. At this point, upper edge 98 of first glue condiment flap 84 becomes aligned with and eighth fold line 72. First condiment glue flap 84 is adhesively bonded to the interior surface of front wall 22. First triangular wall 80 is free to fold along tenth fold line 88. Also, second triangular wall 82 is free to fold along ninth fold line 90.

Second condiment glue flap 86 is adhesively bonded to the interior side of first sidewall 18 at a location and position which is determined by aligning ninth fold line 90 with third fold line 40 and second triangular wall 82 flush with first wall 18. This results in the stowed configuration of the condiment compartment. In order to deploy the condiment compartment, the user pulls convex edge 96 of first triangular wall 80 in the direction of the interior of the food compartment. The first and second triangular walls 80 and 82 are flexible thus bend to allow the wall to shift from the stowed position shown in FIG. 4 to the deployed position shown in FIG. 5. As stated earlier, because the distance between points C and D is longer than the distance between points A and B, the wall snaps open into a deployed position and remains deployed even with no condiment inside.

Figure 12:
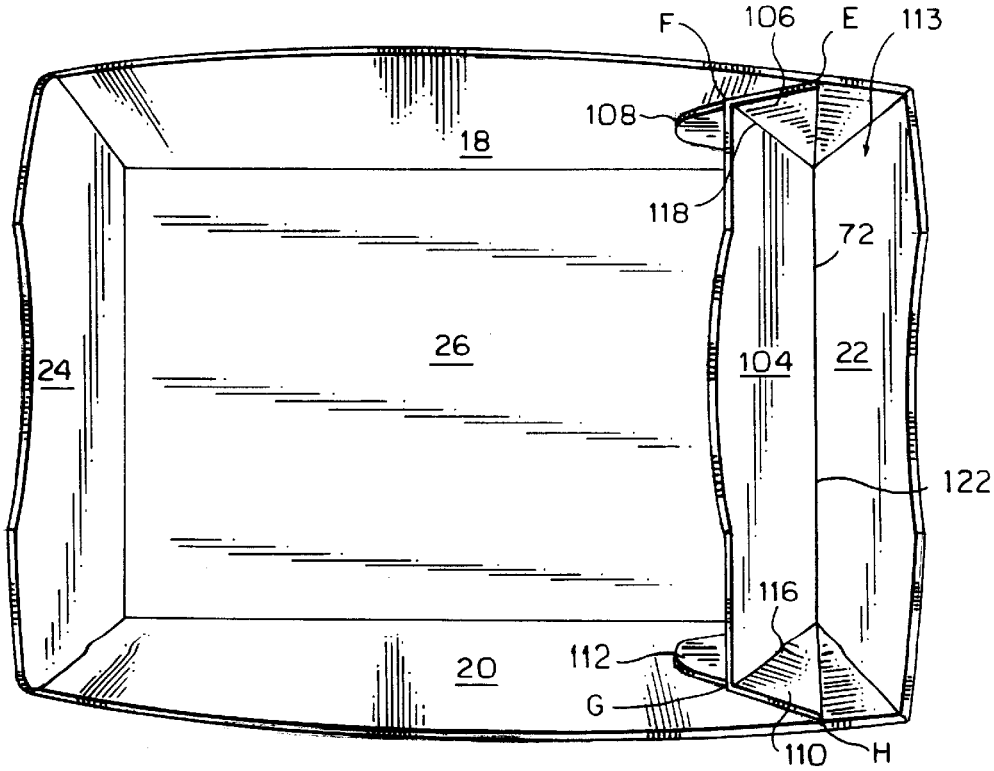
FIG. 12 is a top plan view of a food tray according to a third embodiment of the present invention.
Figure 11:
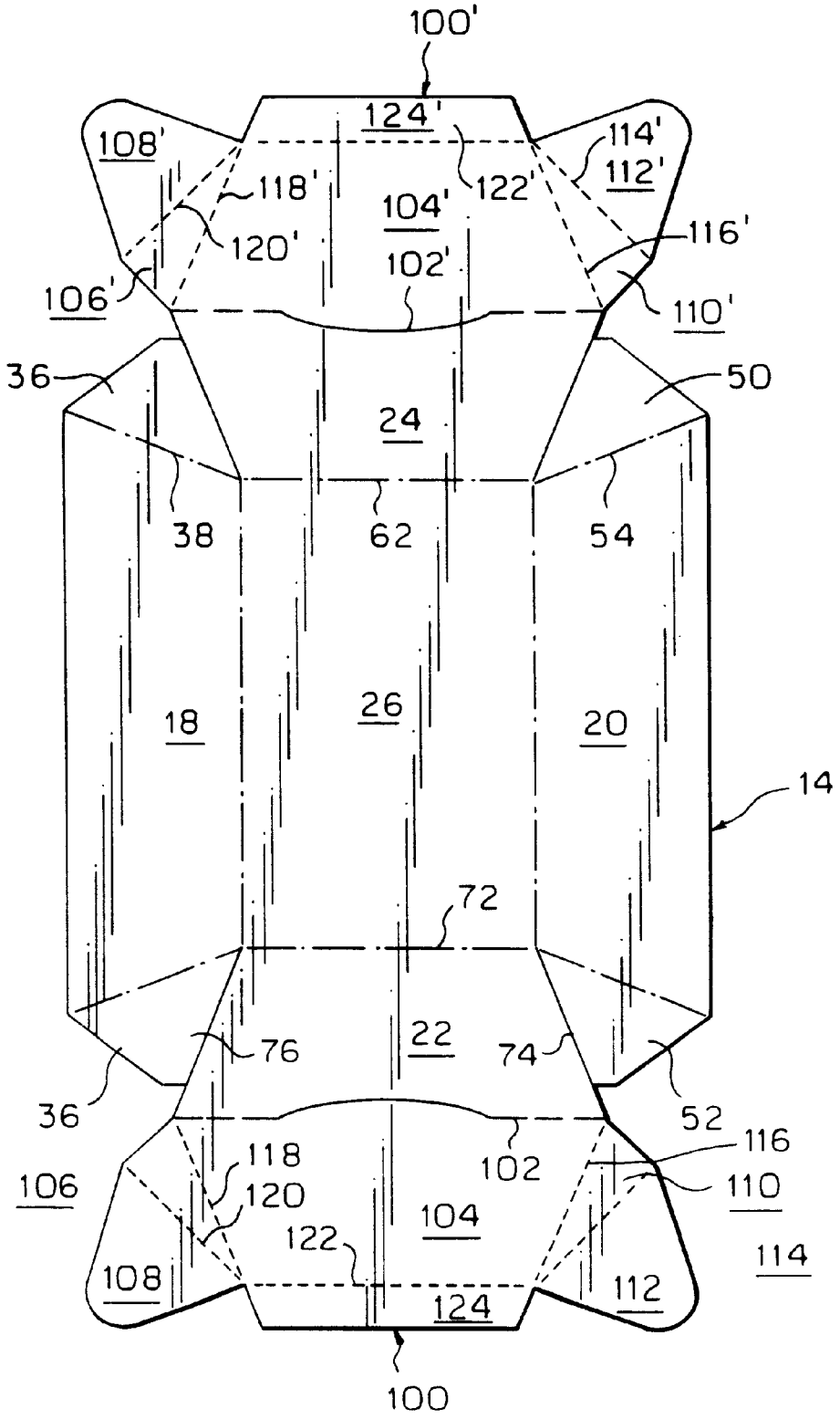
FIG. 11 is a plan view of a blank for forming the tray of FIG. 7.
Figure 13:
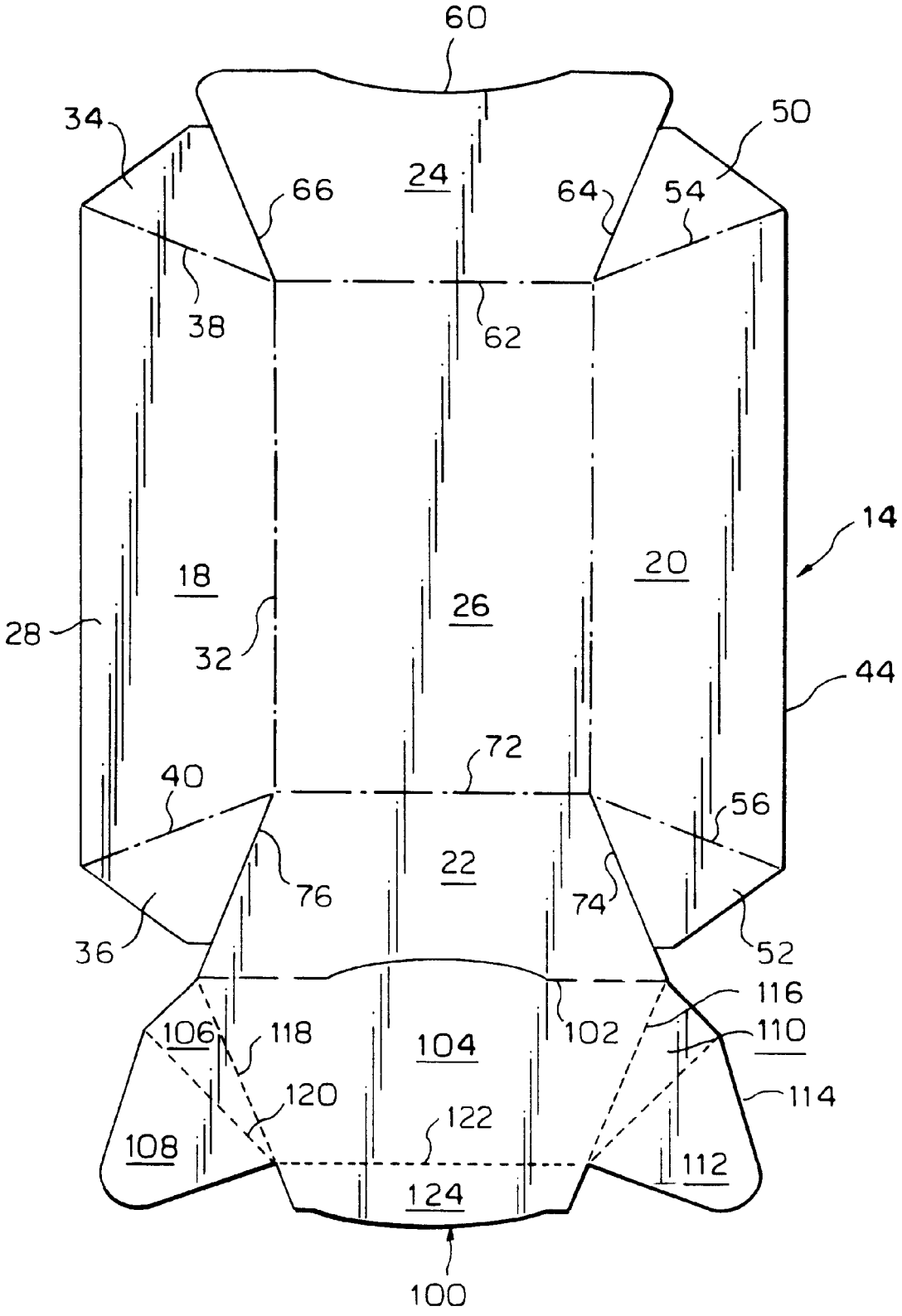
FIG. 13 is a plan view of a blank for forming the tray of FIG. 12.

Referring now to FIGS. 12 and 13, a second embodiment of the invention is illustrated. In this embodiment, elements common to the first embodiment are identified by like numerals. The condiment compartment in this embodiment is elongated, spans the width of the tray and deploys and stows relative to the front wall of the tray. Of course, this compartment could also be formed along one of the long sides of the rectangular tray or along the rear wall of the tray.

A flap 100 is attached to front wall 22 along a perforated cut line 102, and spans the width of the upper edge of front wall 22. When folded over front wall 22 and attached thereto as described below, this flap will form a condiment compartment 113 having a main wall 104. Condiment compartment 113 shown in an open position in FIG. 12, further includes a first triangular portion 106 integral with main wall 104 along a fourteenth fold line 118 on one side, and integral with a third glue flap 108 along a fifteenth fold line 120 on the opposing side. A second triangular portion 110 is integral with main wall 104 along a sixteenth fold line 116 on one side, and is joined and integral with a fourth glue flap 112 along a seventeenth fold line 114. A glue flap 124 is integral with the lower edge of main wall 104 along an eighteenth fold line 122. Fourteenth and sixteenth fold lines 116, 118 are divergent.

It should be appreciated that condiment compartment 113 is the area confined between first and second triangular portions 106 and 110, main wall 104, front wall 22, and is closed off on the corners along the fifteenth and seventeenth fold lines 120 and 114, and on the bottom along eighth fold line 72 of bottom panel 26. All edges of the condiment compartment are glued to the sidewalls and/or bottom wall of the tray thus providing a good seal to hold a condiment in place.

As stated hereinabove, main wall 104 is joined with front wall 22 on the unitary blank along the perforated thirteenth line 102, which may is scored along most of its length and connected to wall 22 at a small number of locations. This arrangement holds panel 100 to wall 22 during manufacture and assembly, but allows a user to easily break the connections between wall 22 and panel 100 when the tray is assembled so that the condiment compartment can be deployed.

The food compartment is assembled in the same way as the first embodiment explained hereinabove. The condiment compartment 113 is assembled as follows: First, top portion 124 is slightly folded outwardly along eighteenth fold line 122. Next, main wall 104 is folded inwardly into the food compartment along thirteenth fold line 102 and is placed flush with front wall 22. Eighteenth fold line 122 overlays eighth fold line 72 and top portion 124 rests on the top surface of bottom panel 26 and is adhesively bonded thereon.

Fourth glue flap 112 is adhesively bonded to the inner surface of second sidewall 20 and seventeenth fold line 114 overlays sixth fold line 56 and side edge 74 of front wall 22. Similarly, at the opposing side, third glue flap 108 is adhesively bonded to the inner surface of first sidewall 18 in such configuration that fifteenth fold line 120 overlays third fold line 40 and side edge 76 of front wall 22. Therefore, second portion 100 is adhesively bonded and secured to first portion 14 where in the stowed position and configuration of the condiment compartment, main wall 104 is flush with front wall 22, bottom portion 124 is secured on the top surface of bottom panel 26, and third and fourth glue flaps 108, 112 are secured to first and second sidewalls 18, 20. To deploy condiment compartment 113, main wall 104 is pulled away from front wall 22 breaking the few connections therebetween.

As best seen in FIG. 12, the distance E-F-G-H is greater that the distance between points E and F, and therefore, when panel 104 is moved away from front wall 22, front panel 22 and the triangular panels 106 and 110 are deformed until panel 104 reaches the position shown in FIG. 12. Because these panels also need to be deformed to move panel 104 back against front wall 22, the condiment compartment tends to stay in an open position, even when it is empty.

Referring now to FIGS. 7–11, a third embodiment of the invention is illustrated. This embodiment is identical to the second embodiment described above, except a second identical condiment compartment is utilized at the opposing side of the tray along rear wall 24. Reference numerals with primes are used to designate portions of the second compartment, for example the second compartment 113' includes a wall 104' corresponding to wall 104 of the second embodiment. The production and assembly of this embodiment will easily be understood from reading the above description of a tray having single compartment spanning its width and will not be described further.

Figure 14:
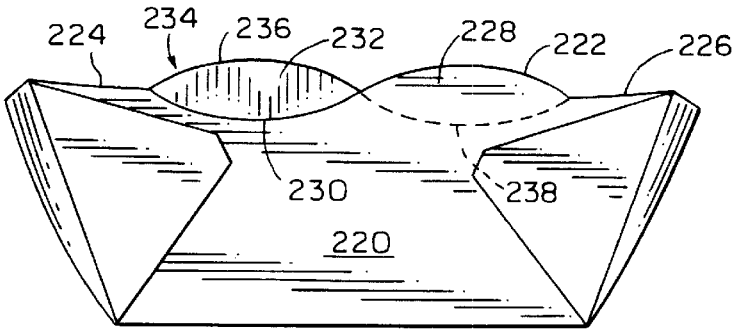
FIG. 14 is a front elevational view of a food tray according to a fourth embodiment of the invention; and, FIG. 15 is a plan view of a blank for forming the tray of FIG. 14.
Figure 15:
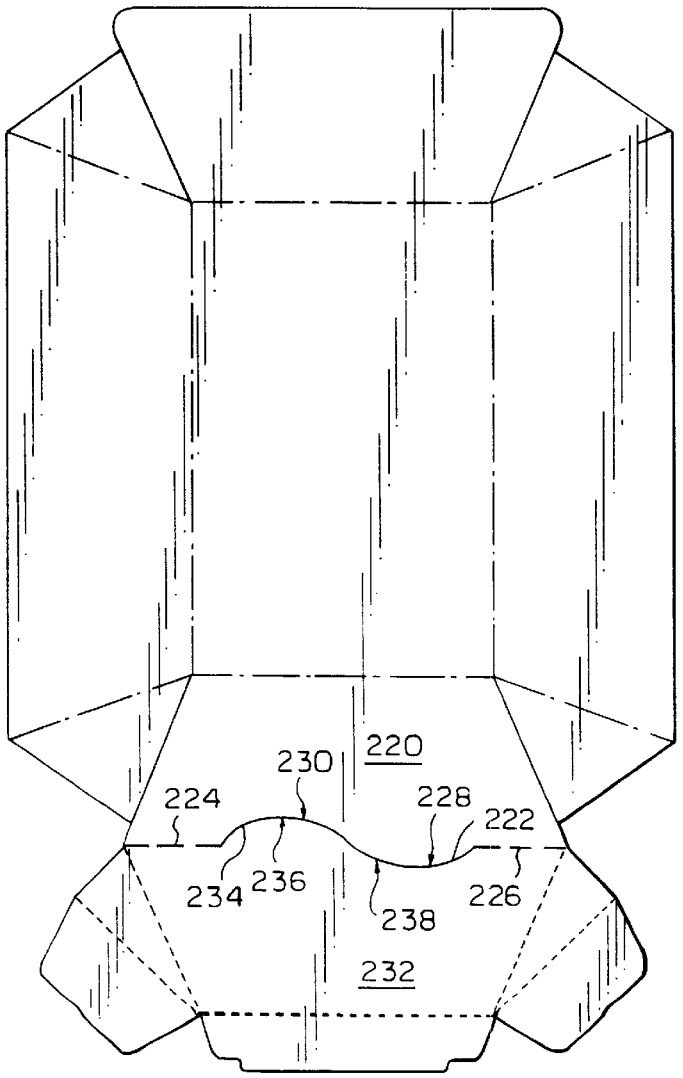

A fourth embodiment of the invention is shown in FIGS. 14 and 15. This embodiment is substantially the same as the second embodiment described above except in the area of the top edges of the front wall and the condiment compartment wall. FIG. 14 shows a front view of a fourth embodiment of the invention. The container includes a front wall 220 having a top edge 222 which includes first and second linear outer portions 224, 226 and a sinusoidal central portion having a first arched section 228 curving away from front wall 220 and a second arched section 230 cut into front wall 220. The panel further includes a wall 232 that shifts to form a condiment compartment as described above. Wall 232 has a top edge 234 with a first portion 236 arching away from the center of wall 232 and a second portion 238 cutting into wall 232. When the container is assembled, first arched section 236 of wall 232 overlies the second arched section 230 of front wall 220. This arrangement produces a wall for forming a condiment compartment that functions substantially the same as the previous embodiment but which provides an increased gripping surface to make the condiment compartment wall 232 easier to separate from front wall 220. A blank for forming a tray according to this embodiment is shown in FIG. 15.

While preferred embodiments have been shown and described, various modifications and changes may be made thereto without departing from the spirit and scope of the invention. Accordingly, it is to be understood that the present invention has been described by way of illustration only, and such illustrations and embodiments as have been disclosed herein are not to construed as limiting to the claims.

We claim:

1. A container comprising:

a bottom wall, a first sidewall, a second sidewall, and a third sidewall;

a panel having a first end connected to said first sidewall at a first point and a second end connect to said second sidewall at a second point, said panel being shiftable from a first position overlying a portion of said first sidewall and a second position wherein a portion of said panel is spaced apart from said first sidewall, wherein said panel comprises a first subpanel having a first edge connected to said first sidewall at a first location and a second edge, a second subpanel having a first edge connected to said first subpanel second edge and a second edge, and a third subpanel having a first edge connected to said second subpanel second edge and a second edge connected to said second sidewall at a second location, and wherein said second subpanel includes a third edge, said bottom and said first sidewall meet at a corner, and said second subpanel third edge overlies said corner between said bottom and said first sidewall when said panel is in said first position and said second position.

2. The container of claim 1 wherein said panel comprises first and second subpanels, said first subpanel having a first edge connected to said first sidewall and a second edge, and said second subpanel having a first edge connected to said second sidewall and a second edge connected to said first subpanel second edge.

3. The container of claim 2 wherein said first subpanel is triangular.

4. The container of claim 3 wherein said second subpanel is triangular.

5. The container of claim 2 wherein said first subpanel includes a third edge having a length, said second subpanel includes a third edge having a length, and said first point is separated from said second point by a first distance, the sum of said first subpanel third edge length and said second subpanel third edge length being greater than said first distance.

6. The container of claim 4 wherein said first sidewall, and said second sidewall and said bottom define a corner of said container, and wherein said triangular first panel includes a vertex extending into said corner.

7. The container of claim 4 wherein said first sidewall, and said second sidewall and said bottom define a corner of said container, and wherein said triangular first panel includes a vertex extending into said corner when said panel is in said first position and said second position.

8. The container of claim 5 wherein said first subpanel third edge includes a curved portion.

9. The container of claim 1 wherein said third sidewall connects said first sidewall to said second sidewall.

10. The container of claim 1 including a second panel connected between said first sidewall and said second sidewall.

11. The container of claim 1 wherein said first subpanel includes a third edge having a length, said second subpanel includes a third edge having a length, said third subpanel includes a third edge having a length, and said first point is separated from said second point by a first distance, the sum of said first subpanel third edge length said second subpanel third edge length and said third subpanel third edge length being greater than said first distance.

12. The container of claim 11 including a second panel connected between said first sidewall and said second sidewall.

13. A unitary blank for forming a container comprising a rectangular first panel having first, second, third and fourth edges, a second panel extending from said first panel first edge at a first fold line and having an outer edge; and a flap extending from said second panel outer edge at a second fold line and comprising first, second, third and fourth subpanels, said first subpanel being quadrilateral and having a first edge laying along said first fold line when folded, and wherein said second subpanel includes a first edge collinear with said fold line.

14. The blank of claim 13 wherein said second subpanel first edge is separated from said second panel by a cut.

15. The blank of claim 13 wherein at least two of said subpanels are triangular.

16. The blank of claim 13 wherein said first subpanel has the same shape as said second panel.

17. The blank of claim 16 wherein said first subpanel is connected to said second panel along a fold line and includes first and second side edges, and wherein said second subpanel is connected to said first subpanel first side edge and said third subpanel is connected to said first subpanel second side edge.

18. The blank of claim 17 wherein said second subpanel includes first and second triangular portions separated by a fold line.

19. A container comprising:

a bottom wall, a first sidewall, and a second sidewall;

a panel having a first end connected to said first sidewall at a first point and a second end connect to said second sidewall at a second point, said panel being shiftable from a first position overlying a portion of said first sidewall and a second position wherein a portion of said panel is spaced apart from said first sidewall, wherein said panel comprises first and second subpanels, said first subpanel having a first edge connected to said first sidewall and a second edge, and said second subpanel having a first edge connected to said second sidewall and a second edge connected to said first subpanel second edge, wherein said first and second subpanels are triangular, and wherein said first sidewall, said second sidewall, and said bottom define a corner of said container, and wherein said triangular first panel includes a vertex extending into paid bottom.

20. The container of claim 19 wherein said first subpanel includes a third edge having a length, said second subpanel includes a third edge having a length, and said first point is separated from said second point by a first distance, the sum of said first subpanel third edge length and said second subpanel third edge length being greater than said first distance.

21. The container of claim 19 wherein said first sidewall, and said second sidewall and said bottom define a corner of said container, and wherein said triangular first panel includes a vertex extending into said corner when said panel is in said first position and said second position.

22. The container of claim 20 wherein said first subpanel third edge includes a curved portion.

23. The container of claim 19 including a second panel connected between said first sidewall and said second sidewall.

24. The container of claim 19 wherein said first panel comprises a first subpanel having a first edge connected to said first sidewall at a first location and a second edge, a second subpanel having a first edge connected to said first subpanel second edge and a second edge, and a third subpanel having a first edge connected to said second subpanel second edge and a second edge connected to said second sidewall at a second location.

25. The container of claim 24 wherein said first subpanel includes a third edge having a length, said second subpanel includes a third edge having a length, said third subpanel includes a third edge having a length, and said first point is separated from said second point by a first distance, the sum of said first subpanel third edge length said second subpanel third edge length and said third subpanel third edge length being greater than said first distance.

26. The container of claim 25 including a second panel connected between said first sidewall and said second sidewall.

27. The container of claim 25 wherein said second subpanel includes a fourth edge, said bottom and said first sidewall meet at a corner, and said second subpanel fourth edge overlies said corner between said bottom and said first sidewall when said panel is in said first position and said second position.

* * * * *